US006739010B1

(12) United States Patent
Lin

(10) Patent No.: US 6,739,010 B1
(45) Date of Patent: May 25, 2004

(54) COMBINATION TOOL HAVING A HAMMER

(76) Inventor: Ming-Shuan Lin, No. 29-2, Sec. 1, Tafeng Rd., Tantzu Hsiang, Taichung Hsien (TW)

( * ) Notice: Subject to any disclaimer, the term of this patent is extended or adjusted under 35 U.S.C. 154(b) by 0 days.

(21) Appl. No.: 10/436,264

(22) Filed: May 13, 2003

(51) Int. Cl.[7] ..... B25F 1/00
(52) U.S. Cl. ..... 7/143; 7/145; 7/158
(58) Field of Search ..... 7/143–145, 158, 7/159; 81/20, 21, 25, 26, 180.1

(56) References Cited

U.S. PATENT DOCUMENTS 1,056,920 A * 3/1913 Lovering ..... 30/308.3
1,180,405 A * 4/1916 Lovering ..... 30/308.03
2,406,116 A * 8/1946 Van Slyke ..... 7/145
4,183,385 A * 1/1980 Burkybile ..... 81/25
4,287,623 A * 9/1981 Tarran ..... 7/158
2002/0138914 A1 * 10/2002 Lin ..... 7/143

* cited by examiner

*Primary Examiner*—Joseph J. Hail, III
*Assistant Examiner*—David B. Thomas
(74) *Attorney, Agent, or Firm*—Morgan Lewis & Bockius LLP

(57) ABSTRACT

A combination tool includes a hammer having a head, a handle portion and a neck part, an accessory tool for attachment to the head, and an attachment part connected to the accessory tool and including a socket to receive a hammering end of the head, two retaining walls extending respectively on two sides of the socket to retain therebetween at least the neck part, and a clamping part for pressing the neck part against the socket, thereby retaining removably the accessory tool on the hammer.

18 Claims, 5 Drawing Sheets

COMBINATION TOOL HAVING A HAMMER

BACKGROUND OF THE INVENTION

1. Field of the Invention

The invention relates to a combination tool, more particularly to a combination of a hammer and an accessory tool.

2. Description of the Related Art

Referring to FIG. 1, a conventional combination tool includes a hammer 2 and an accessory tool 1. The hammer 2 has ahead 201 and a handle portion 202 connected to the head 201. The head 201 includes a hammering end 203 having an outer periphery formed with a plurality of inwardly extending grooves 205, and a claw 204 opposite to the hammering end 203. The accessory tool 1 includes a sleeve portion 101 sleeved on the hammering end 203, a tool portion 102 connected integrally to the sleeve portion 101, and a plurality of clamping screws 103 that extend into the respective grooves 205 so as to fasten the accessory tool 1 to the hammer 2.

The aforementioned hammering end 203 of the hammer 2 has to be provided with grooves 205, which is troublesome for processing. Furthermore, since only the clamping screws 103 are used to press tightly the sides of the hammering end 203, the accessory tool 1 is likely to loosen easily from the hammer 2 when subjected to impact induced during operation of the hammer 2.

SUMMARY OF THE INVENTION

Therefore, the object of the present invention is to provide a combination tool that has an accessory tool connected stably to and easily detachable from a hammer in order to overcome the aforementioned drawbacks of the prior art.

According to one aspect of this invention, a combination tool comprises a hammer having a head, a handle portion and a neck part between the head and the handle portion, an accessory tool for attachment to the head, and an attachment part connected to the accessory tool. The attachment part includes a socket disposed adjacent to the accessory tool to receive a hammering end of the head, two retaining walls extending respectively on two sides of the socket to retain therebetween at least the neck part, a cross piece disposed across the retaining walls to abut against one side of the neck part, and a clamping part disposed between the retaining walls to press against the other side of the neck part opposite to the cross piece. The clamping part is operable to move away from the neck part.

According to another aspect of this invention, a device for combination with a hammer having a head, a handle portion, and a neck part between the head and the handle portion, includes an accessory tool and an attachment part. The accessory tool is adapted for attachment to the head. The attachment part is connected to the accessory tool, and includes a socket, two opposite retaining walls, and a clamping part. The socket is disposed adjacent to the accessory tool, and is adapted to receive a hammering end of the head. The retaining walls extend respectively from two sides of the socket in a direction away from the accessory tool. The clamping part is adapted to press the neck part of the hammer against the socket, and is disposed between the retaining walls opposite to the socket.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
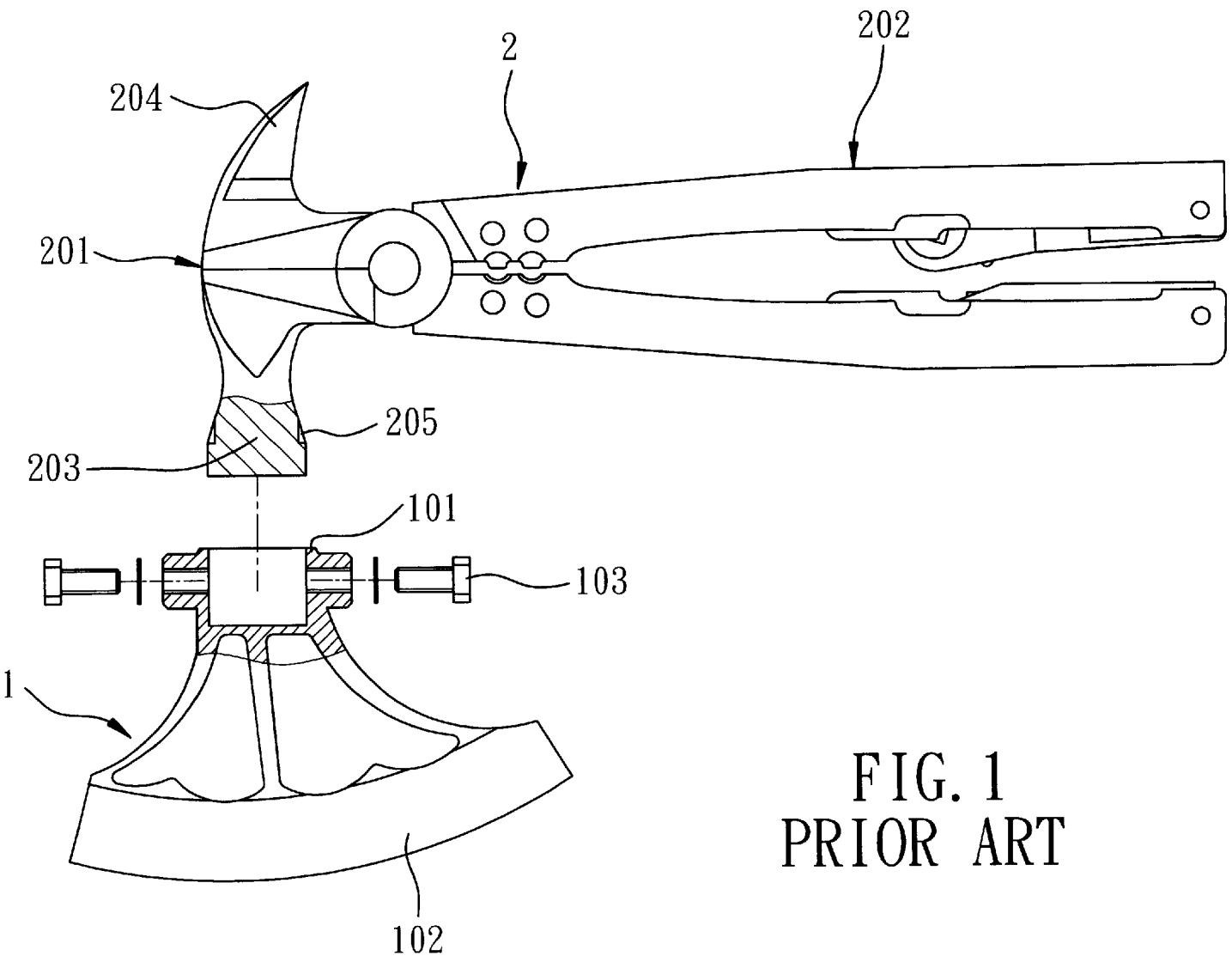
FIG. 1 PRIOR ART
FIG. 1 is a partly sectional schematic view of a conventional combination tool.
Figure 2:
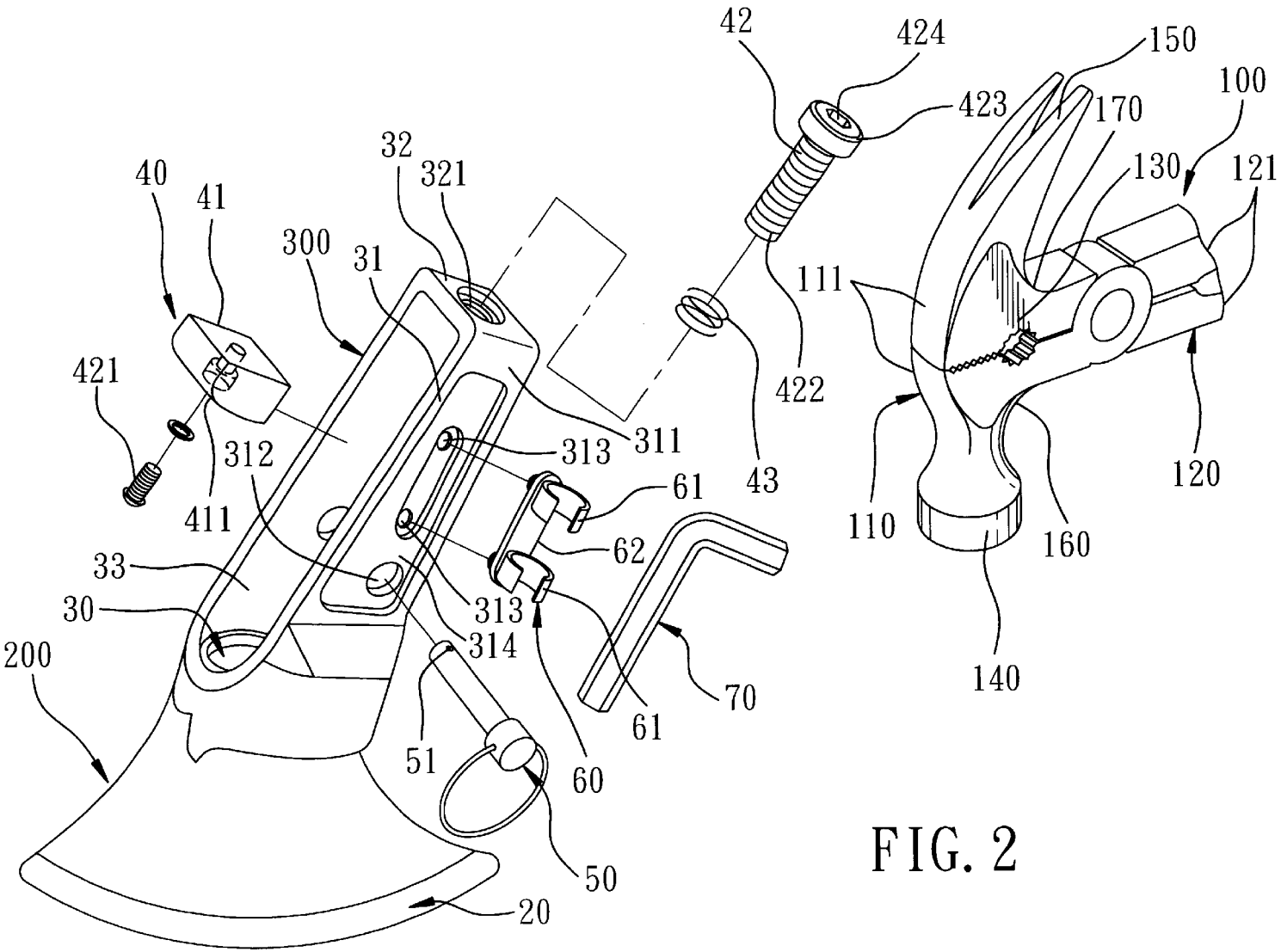
FIG. 2 is an exploded fragmentary perspective view of the preferred embodiment of a combination tool according to the present invention.
Figure 3:
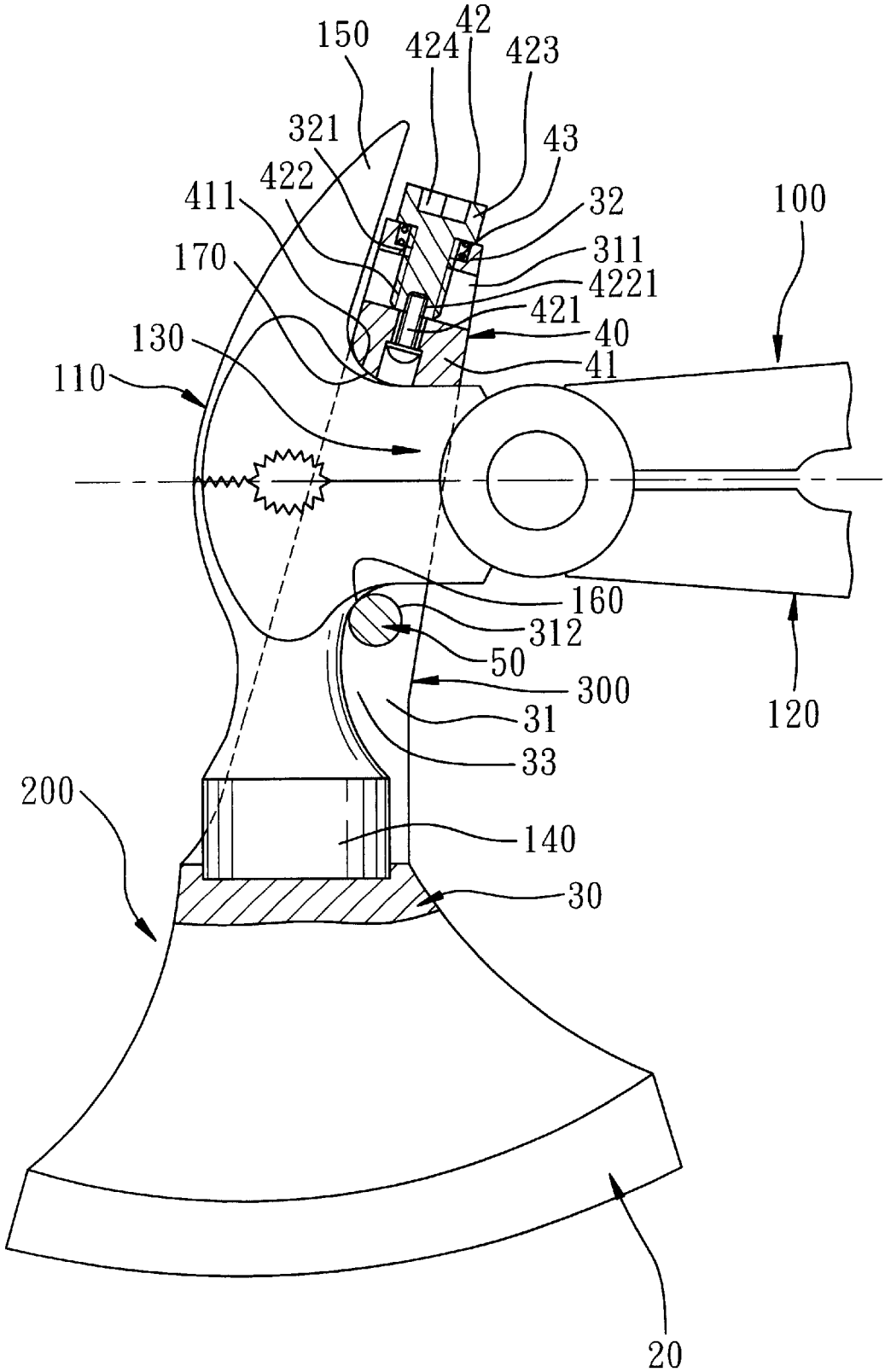
FIG. 3 is a partly sectional fragmentary schematic view of the preferred embodiment in an assembled state.

Referring to FIGS. 2 and 3, the preferred embodiment of a combination tool according to the present invention is shown to comprise a hammer 100, an accessory tool 200, an attachment part 300, and a holder 60.

The hammer 100 has a head 110 with a hammering end 140, a handle portion 120 connected to the head portion 110, and a neck part 130 between the head 110 and the handle portion 120. The head 110 has two jaw-like components 111. The hammering end 140 is integral with one of the components 111. The other one of the components 111 is formed with a claw 150. The handle portion 120 includes a pair of lever handles 121 pivotally connected together and respectively connected to the components 111.

The accessory tool 200 is attached to the hammering end 140 of the head 110 of the hammer 100. In this embodiment, the accessory tool 200 is an axe 20. However, it can also be a spade or a shovel.

The attachment part 300 is connected to the accessory tool 200, and includes a socket 30, two opposite retaining walls 31, a transverse wall 32, a clamping part 40, a locking screw 42, a coiled spring 43, and a cross piece 50. The socket 30 is disposed adjacent to the accessory tool 200 to receive the hammering end 140 of the head 110. The retaining walls 31 extend respectively from two sides of the socket 30 in a direction away from the accessory tool 200. The transverse wall 32 interconnects the retaining walls 31 opposite to the socket 30. The retaining walls 31, the transverse wall 32, and the socket 30 cooperate to define an open space 33 for extension of the head 110 of the hammer 100 therethrough.

The clamping part 40 is disposed between the retaining walls 31 opposite to the socket 30, and is operable to move toward and away from the socket 30. The clamping part 40 includes a press block 41 mounted movably on the transverse wall 32 and having a press face 411 to press a first side 170 of the neck part 130 against the socket 30. The press block 41 is movable between the retaining walls 31 toward and away from the transverse wall 32, and is prevented from rotation by the retaining walls 31.

The locking screw 42 extends threadedly through the transverse wall 32, and has one end fixed to the press block 41. The locking screw 42 has a threaded shank portion 422, and a screw head 423 opposite to the shank portion 422. The shank portion 422 has a bottom end portion formed with an internally extending thread 4221 to engage a threaded screw 421 that passes through the press block 41 so that the locking screw 42 is connected fixedly to the press block 41. The head portion 423 extends outwardly of the transverse wall 32, and is formed with a hexagonal hole 424 to receive a hexagonal wrench 70. The coiled spring 43 is sleeved around the locking screw 42 between the screw head 423 and the transverse wall 32. The transverse wall 32 has a recess 321 for receiving the coiled spring 43.

The cross piece 50 is disposed across the retaining walls 31, and abuts against a second side 160 of the neck part 130 opposite to the first side 170. In this embodiment, the cross piece 50 is a rod that penetrates through a pair of aligned holes 312 in the retaining walls 31.

The holder 60 is attached to one of the retaining walls 31, which has an outer face 311 formed with an indented part 314 to receive and retain the holder 60. The holder 60 has a mounting plate 62 received in and fastened to the indented part 314 by engaging a pair of aligned holes 313 in the indented part 314 in a press-fitting manner. Two holder rings 61 are attached to the mounting plate 62 to hold the wrench 70.

Figure 4:
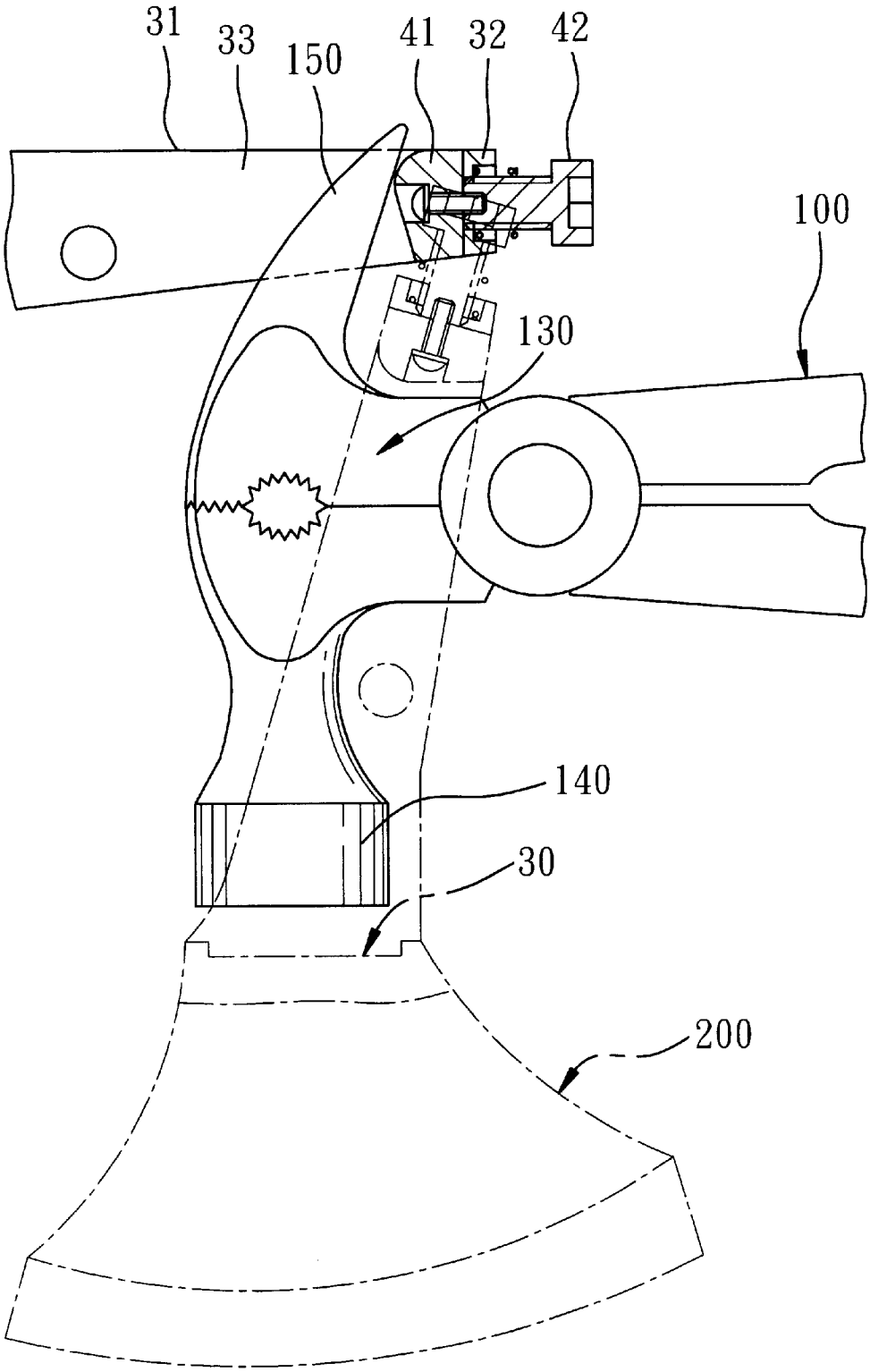
FIG. 4 is another partly sectional fragmentary schematic view of the preferred embodiment, illustrating how a hammer is initially inserted into an accessory tool.
Figure 5:
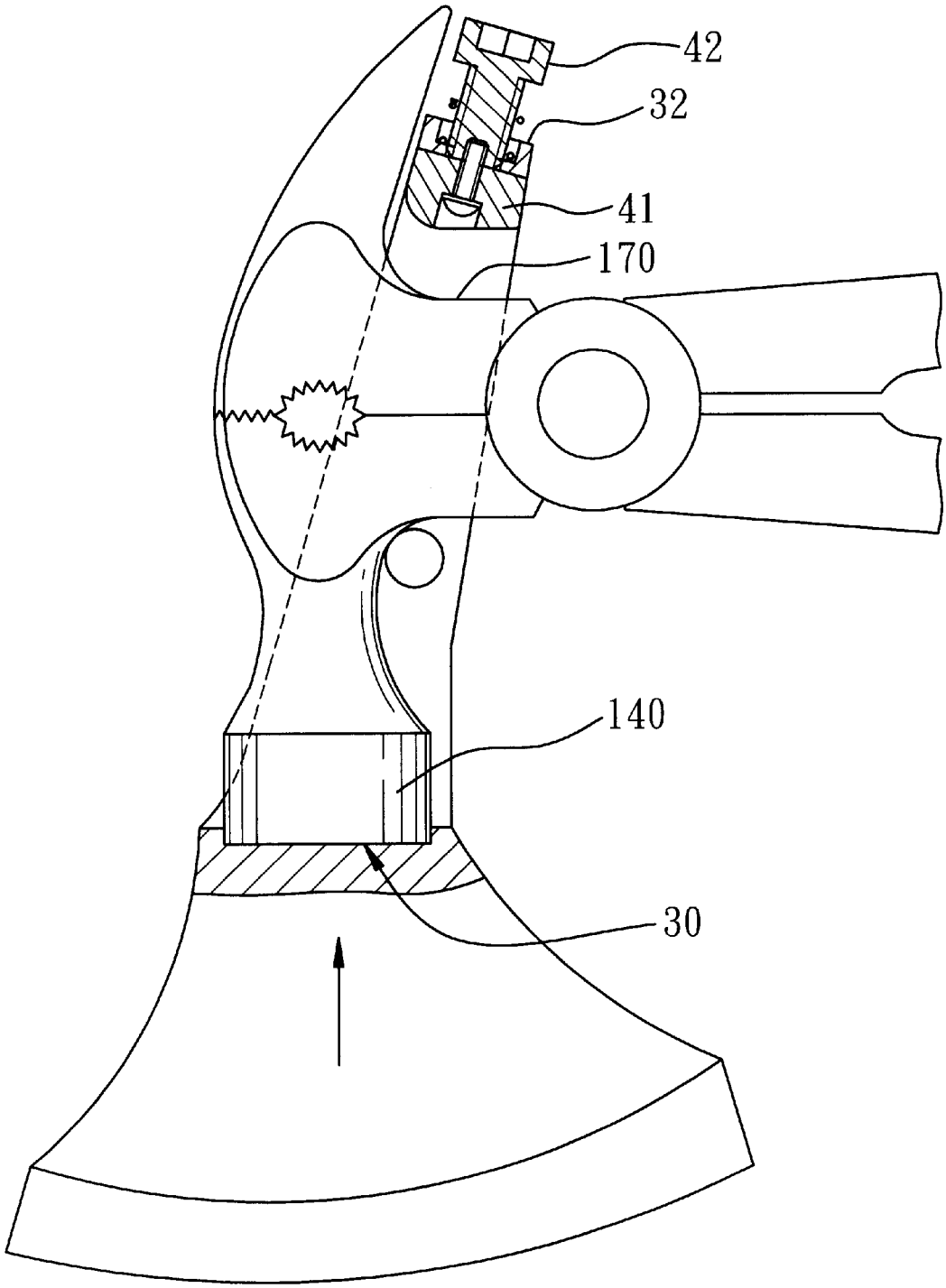
FIG. 5 is yet another partly sectional fragmentary schematic view of the preferred embodiment, illustrating how the hammer is positioned after insertion into the accessory tool.

When the accessory tool 200 is to be assembled on the hammer 100, the locking screw 42 is initially threadedly loosened to move the press block 41 toward the transverse wall 32, after which, the claw 150 of the hammer 100 is extended through the open space 33 in the attachment part 300, as shown by the solid lines in FIG. 4. Then, the attachment part 300 is rotated until the socket 30 is located below the hammering end 140 of the hammer 100, as shown by the phantom lines in FIG. 4. Afterwards, the socket 30 is moved upward to receive the hammering end 140 of the hammer 100, as shown in FIG. 5. Referring back to FIG. 3, the locking screw 42 is thereafter tightened on the transverse wall 32 to move and press the press block 41 toward the first side 170 of the neck part 130. At this time, the coiled spring 43 is compressed, and the locking screw 42 is positioned tightly due to the biasing force of the coiled spring 43. The accessory tool 200 is thereby connected to the hammer 100. The final step is to insert the cross piece 50 through the holes 312 so that the cross piece 50 abuts against the second side 160 of the neck part 130 to provide a stable connection between the accessory tool 200 and the hammer 100. Note that the cross piece 50 has a detent ball 51 (see FIG. 2), which can engage the outer face of one of the retaining walls 31 to lock the cross piece 50 on the retaining walls 31.

To detach the accessory tool 200 from the hammer 100, the foregoing assembly steps are simply performed in a reverse order, that is, the cross piece 50 is first removed, followed by loosening of the locking screw 42 so as to move the press block 41 away from the first side 170 of the neck part 130. Then, the socket 30 is separated from the hammering end 140, and the accessory tool 200 and the attachment part 300 are rotated out of the head 110 of the hammer 100.

Thus, from the aforementioned description of the preferred embodiment of the combination tool of the present invention, it is apparent that the accessory tool 200 can be easily connected to and detached from the hammer 100. Furthermore, the structure of the hammer 100 need not be modified in order to connect with the accessory tool 200 so that multi-purpose functions can be achieved. Moreover, due to the many positioning points produced by the insertion of the hammering end 140 into the socket 30, the abutment of the press block 41 and the cross piece 50 against the first and second sides 170, 160 of the neck part 130, and the retaining action of the retaining walls 31, the accessory tool 200 is stably connected to the hammer 100. Additionally, the engagement of the locking screw 42 with the press block 41 can ensure that the accessory tool 200 is not likely to loosen during use of the combination tool.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A combination tool comprising:

a hammer having a head, a handle portion and a neck part between said head and said handle portion;

an accessory tool for attachment to said head; and an attachment part connected to said accessory tool and including a socket disposed adjacent to said accessory tool to receive a hammering end of said head, two opposite retaining walls extending respectively from two sides of said socket in a direction away from said accessory tool, and a clamping part for pressing said neck part against said socket, said clamping part being disposed between said retaining walls opposite to said socket.

2. The combination tool as claimed in claim 1, wherein said handle portion of said hammer includes a pair of lever handles pivotally connected together, said head having two jaw-like components respectively connected to said lever handles, said hammering end being integral with one of said components.

3. The combination tool as claimed in claim 2, wherein the other one of said components is formed with a claw.

4. The combination tool as claimed in claim 3, wherein said accessory tool is an axe.

5. The combination tool as claimed in claim 1, wherein said attachment part further includes a cross piece disposed across said retaining walls to abut against said neck part opposite to said clamping part.

6. The combination tool as claimed in claim 5, wherein said cross piece is a rod penetrating through said retaining walls.

7. The combination tool as claimed in claim 1, wherein said attachment part further includes a transverse wall interconnecting said retaining walls opposite to said socket, said clamping part including a press block mounted movably on said transverse wall and having a press face to press against said neck part, said press block being movable between said retaining walls toward and away from said transverse wall, said retaining walls preventing said press block from rotation.

8. The combination tool as claimed in claim 6, wherein said attachment part further includes a locking screw threadedly extending through said transverse wall and having one end fixed to said press block.

9. The combination tool as claimed in claim 7, wherein said attachment part further includes a coiled spring, said locking screw having a screw head extending outwardly of said transverse wall, said coiled spring being sleeved around said locking screw between said screw head and said transverse wall, said transverse wall having a recess receiving said coiled spring.

10. The combination tool as claimed in claim 1, further comprising a holder attached to one of said retaining walls, said one of said retaining walls having an outer face formed with an indented part to receive and retain said holder.

11. A device for combination with a hammer having ahead, a handle portion and a neck part between the head and the handle portion, comprising:

an accessory tool adapted for attachment to the head; and an attachment part connected to said accessory tool and including a socket which is disposed adjacent to said accessory tool and which is adapted to receive a hammering end of the head, two opposite retaining walls extending respectively from two sides of said socket in a direction away from said accessory tool, and a clamping part adapted to press the neck part of the hammer against said socket, said clamping part being disposed between said retaining walls opposite to said socket.

12. The combination tool as claimed in claim 11, wherein said accessory tool is an axe.

13. The combination tool as claimed in claim 11, wherein said attachment part further includes a cross piece disposed across said retaining walls and adapted to abut against the neck part of the hammer opposite to said clamping part.

14. The combination tool as claimed in claim 13, wherein said cross piece is a rod penetrating through said retaining walls.

15. The combination tool as claimed in claim 11, wherein said attachment part further includes a transverse wall interconnecting said retaining walls opposite to said socket, said clamping part including a press block mounted movably on said transverse wall and having a press face, said press block being movable between said retaining walls toward and away from said transverse wall, said retaining walls preventing said press block from rotation.

16. The combination tool as claimed in claim 15, wherein said attachment part further includes a locking screw threadedly extending through said transverse wall and having one end fixed to said press block.

17. The combination tool as claimed in claim 16, wherein said attachment part further includes a coiled spring, said locking screw having a screw head extending outwardly of said transverse wall, said coiled spring being sleeved around said locking screw between said screw head and said transverse wall, said transverse wall having a recess receiving said coiled spring.

18. The combination tool as claimed in claim 11, further comprising a holder attached to one of said retaining walls, said one of said retaining walls having an outer face formed with an indented part to receive and retain said holder.

* * * * *